US006042463A

United States Patent [19]

Johnson et al.

[11] Patent Number: 6,042,463

[45] Date of Patent: Mar. 28, 2000

[54] POLYCRYSTALLINE DIAMOND COMPACT CUTTER WITH REDUCED FAILURE DURING BRAZING

[75] Inventors: David M. Johnson, Westerville, Ohio; Frederic J. Klug, Schenectady, N.Y.

[73] Assignee: General Electric Company, Pittsfield, Mass.

[21] Appl. No.: 08/975,028

[22] Filed: Nov. 20, 1997

[51] Int. Cl.[7] ..... B23F 21/03

[52] U.S. Cl. ..... 451/540; 51/309; 451/548

[58] Field of Search ..... 125/3, 28; 451/540, 451/548; 51/307, 309

[56] References Cited

U.S. PATENT DOCUMENTS

| | | | |
|---|---|---|---|
| 2,978,847 | 4/1961 | Shoemakers | 451/548 X |
| 3,141,746 | 7/1964 | DeLai . | |
| 3,256,646 | 6/1966 | Mockli | 451/548 X |
| 3,609,818 | 10/1971 | Wentorf, Jr. . | |
| 3,745,623 | 7/1973 | Wentorf, Jr. et al. . | |
| 3,850,591 | 11/1974 | Wentorf, Jr. . | |
| 4,394,170 | 7/1983 | Sawaoka et al. . | |
| 4,403,015 | 9/1983 | Nakai et al. . | |
| 4,784,023 | 11/1988 | Dennis . | |
| 4,794,326 | 12/1988 | Friedl . | |
| 4,954,139 | 9/1990 | Cerutti . | |
| 4,972,637 | 11/1990 | Dyer . | |
| 5,007,207 | 4/1991 | Phaal | 451/548 |
| 5,199,832 | 4/1993 | Meskin et al. | 451/548 X |
| 5,467,669 | 11/1995 | Stroud . | |
| 5,484,330 | 1/1996 | Flood et al. . | |
| 5,486,137 | 1/1996 | Flood et al. . | |
| 5,494,477 | 2/1996 | Flood et al. . | |
| 5,885,149 | 3/1999 | Gillet et al. | 451/548 X |

FOREIGN PATENT DOCUMENTS

| | | |
|---|---|---|
| 0 604 211 A1 | 6/1994 | European Pat. Off. . |
| 0 706 981 A2 | 4/1996 | European Pat. Off. . |
| 0 699 817 A2 | 9/1996 | European Pat. Off. . |

*Primary Examiner*—Timothy V. Eley

[57] ABSTRACT

A supported polycrystalline compact (PC) cutter made under high temperature, high pressure (HT/HP) processing conditions having non-planar interfaces between the PC layer and a cemented carbide support layer. The carbide PC interface geometry is such that one or more protrusions extend from the support layer into the PC layer. The protrusions have a low cobalt metal binder content of about 3–9% by weight. The low cobalt metal binder content in the protrusions results in enhanced performance and improved resistance to cracking during installation and/or to brazing breakage.

12 Claims, 8 Drawing Sheets

POLYCRYSTALLINE DIAMOND COMPACT CUTTER WITH REDUCED FAILURE DURING BRAZING

FIELD OF THE INVENTION

The present invention relates to supported polycrystalline diamond compacts (PDCs) made under high temperature, high pressure (HT/HP) processing conditions, and more particularly to supported PDC compacts having non-planar interfaces between the PDC layer and the cemented carbide support layer. The object of the present invention is to provide a PDC cutter with improved resistance to cracking during installation.

BACKGROUND OF THE INVENTION

Abrasive compacts are used extensively in cutting, milling, grinding, drilling and other abrasive operations. The abrasive compacts typically consist of polycrystalline diamond or cubic boron nitride particles bonded into a coherent hard conglomerate. The abrasive particle content of abrasive compacts is high and there is an extensive amount of direct particle-to-particle bonding. Abrasive compacts are made under elevated temperature and pressure conditions at which the abrasive particle, be it polycrystalline diamond or cubic boron nitride, is crystallographically stable.

Abrasive compacts tend to be brittle and, in use, they are frequently supported by being bonded to a cemented carbide substrate. Such supported abrasive compacts are known in the art as composite abrasive compacts. The composite abrasive compact may be used as such in the working surface of an abrasive tool. Alternatively, particularly in drilling and mining operations, it has been found advantageous to bond the composite abrasive compact to an elongated cemented carbide pin to produce what is known as a stud cutter. The stud cutter is then mounted in the working surface of a drill bit or a mining pick.

Fabrication of the composite is typically achieved by placing a cemented carbide substrate into the container of a press. A mixture of diamond grains or diamond grains and catalyst binder is placed atop the substrate and compressed under HT/HP conditions. In so doing, metal binder migrates from the substrate and "sweeps" through the diamond grains to promote a sintering of the diamond grains. As a result, the diamond grains become bonded to each other to form a diamond layer, and that diamond layer is bonded to the substrate along a conventionally planar interface. The metal binder occupies the space between the diamond grains with little or no porosity in the sintered compact. Methods for making diamond compacts and composite compacts are more fully described in U.S.Pat. Nos. 3,141,746 ('746); 3,745,623('623); 3,609,818 ('818); 3,850,591 ('591); 4,394,170 ('170); 4,403,015 ('015); 4,794,326 ('326); and 4,954,139 ('139), the disclosures of which are expressly incorporated herein by reference.

A composite formed in the above-described manner may be subject to a number of shortcomings. For example, the coefficients of thermal expansion and elastic constants of cemented carbide and diamond are different. Thus, during heating or cooling of the PDC, thermally induced stresses occur at the interface between the diamond layer and the cemented carbide substrate. The magnitude of these stresses is dependent on the applied pressure, the temperature of zero stress and the disparity in thermal expansion coefficients and elastic constants.

Another potential shortcoming which should be considered relates to the creation of internal stresses within the diamond layer which can result in a fracturing of that layer. Such stresses also result from the presence of the cemented carbide substrate and are distributed according to the size, geometry and physical properties of the cemented carbide substrate and the polycrystalline diamond layer.

European Patent Application No. 0133 386 suggests PDC in which the polycrystalline diamond body is completely free of metal binders and is to be mounted directly on a metal support. However, the mounting of a diamond body directly on metal presents significant problems relating to the inability of the metal to provide sufficient support for the diamond body. The European Patent Application further suggests the use of spaced ribs on the bottom surface of the diamond layer which are to be embedded in the metal support.

According to the European Patent Application, the irregularities can be formed in the diamond body after the diamond body has been formed, e.g., by laser or electronic discharge treatment, or during the formation of the diamond body in a press, e.g., by the use of a mold having irregularities. As regards the latter, it is further suggested that a suitable mold could be formed of cemented carbide; in such case, however, metal binder would migrate from the mold and into the diamond body, contrary to the stated goal of providing a metal free diamond layer. The reference proposes to mitigate this problem by immersing the thus-formed diamond/carbide composite in an acid bath which would dissolve the carbide mold and leach all metal binder from the diamond body. There would thus result a diamond body containing no metal binder and which would be mounted directly on a metal support. Notwithstanding any advantages which may result from such a structure, significant disadvantages still remain, as explained below.

In sum, the European Patent Application proposes to eliminate the problems associated with the presence of a cemented carbide substrate and the presence of metal binder in the diamond layer by completely eliminating the cemented carbide substrate and the metal binder. However, even though the absence of metal binder renders the diamond layer more thermally stable, it also renders the diamond layer less impact resistant. That is, the diamond layer is more likely to be chipped by hard impacts, a characteristic which presents serious problems during the drilling of hard substances such as rock.

It will also be appreciated that the direct mounting of a diamond body on a metal support will not, in itself, alleviate the previously noted problem involving the creation of stresses at the interface between the diamond and metal, which problem results from the very large disparity in the coefficients of thermal expansion between diamond and metal. For example, the thermal expansion coefficient of diamond is about $45\times10^7$ cm/cm/° C. as compared to a coefficient of $150–200\times10^7$ cm/cm/° C. for steel. Thus, very substantial thermally induced stresses occur in the cutter.

Recently, various PDC structures have been proposed in which the diamond/carbide interface contains a number of ridges, grooves or other indentations aimed at reducing the susceptibility of the diamond/carbide interface to mechanical and thermal stresses. In U.S. Pat. No. 4,784,023 ('023), a PDC includes an interface having a number of alternating grooves and ridges, the top and bottom of which are substantially parallel with the compact surface and the sides of which are substantially perpendicular the compact surface.

U.S. Pat. No. 4,972,637 ('637) provides a PDC having an interface containing discrete, spaced recesses extending into the cemented carbide layer, the recesses containing abrasive material (e.g., diamond) and being arranged in a series of rows, each recess being staggered relative to its nearest neighbor in an adjacent row. It is asserted in the '637 patent that as wear reaches the diamond/carbide interface, the recesses, filled with diamond, wear less rapidly than the cemented carbide and act, in effect, as cutting ridges or projections. When the PDC is mounted on a stud cutter, as shown in FIG. 5 of the '637 patent, the wear plane 38 exposes carbide regions 42 which wear much more rapidly than the diamond material in the recesses 18. As a consequence, depressions develop in these regions between the diamond filled recesses. The '637 patent asserts that these depressed regions, which expose additional edges of diamond material, enhance the cutting action of the PDC cutter.

U.S. Pat. No. 5,007,207 ('207) presents an alternative PDC structure having a number of recesses in the carbide layer, each filled with diamond, which make up a spiral or concentric circular pattern, looking down at the disc shaped compact. Thus, the structure in the '207 patent differs from the structure in the '637 patent in that, rather than employing a large number of discrete recesses, the structure of the '207 patent uses one or a few elongated recesses which make up a spiral or concentric circular pattern. FIG. 5 in the '207 patent shows the wear plane which develops when the PDC is mounted and used on a stud cutter. As with the '637 patent, the wear process creates depressions in the carbide material between the diamond filled recesses. Like the '207 patent, the '637 patent also asserts that these depressions which develop during the wear process enhance cutting action. In addition to enhancing cutting action, non-planer interfaces have also been presented in U.S. Pat. Nos. 5,484,330 ('330), 5,494,477 ('477) and 5,486,137 ('137) which reduce the susceptibility to cutter failure by have having favorable residual stresses in critical areas during cutting.

Whereas the aforementioned patents assert a desirable cutting action in the rock and also favorable residual stresses in during cutting, it is also highly desirable to minimize the diamond layer's susceptibility to fracture during installation into the drill bit.

SUMMARY OF THE INVENTION

The present invention relates to supported polycrystalline diamond compacts made under HT/HP processing conditions, and more particularly to supported PDCs having improved shear strength and impact resistance properties.

In PDCs, the interface between the tungsten carbide (WC) and the polycrystalline diamond (PCD) can have a wide variety of surface geometries. It has been found that WC protrusions (See FIG. 1) into the PCD layer can often cause cracking of the PCD layer during the brazing of the cutter onto the bit. This cracking is caused by the thermal mismatch of the WC and the PCD. By providing WC protrusions with a low Cobalt (Co) content, cracking of the PDC can be avoided or greatly mitigated during brazing.

A protrusion is defined as a volume of carbide that protrudes into the PCD layer and is surrounded on its top and sides by PCD. Examples of this would be local regions of WC that exist as bumps, dimples, blocks, saw-tooth shapes, sinusoid shapes, etc., that protrude into the PCD layer. Another example is grooves in the PCD layer (at the WC-PCD interface) filled with WC which run completely across the cutter. Many surface interface geometries are preferred between the WC substrate and the PCD abrasive layer on a cutter design.

Cracking of the abrasive layer may occur due to: (1) in-process stresses, (2) residual stresses, (3) thermal stresses which occur during the heating of the cutter installation (brazing). (Cutters are made using a HT/HP process.) The subject of this disclosure is to address cracking due to (2) and (3).

Most PDC cutters are manufactured with a one piece WC support which is fitted into a refractory metal container which contains the abrasive un-sintered diamond feed. The object of this invention is to provide a PCD cutter with improved resistance to cracking during installation by decreasing the Co level in the WC protrusion into the PCD layer.

Other objects, features, and characteristics of the present invention, as well as the methods of operation and functions of the related elements of the structure, will become more apparent upon consideration of the following detailed description with reference to the accompanying drawings, all of which form a part of this specification.

BRIEF DESCRIPTION OF THE DRAWINGS

The detailed description below describes the preferred embodiments of the invention and is intended to be read in conjunction with the following set of drawings.

DETAILED DESCRIPTION OF THE PREFERRED EMBODIMENTS

Polycrystalline diamond compacts (PDCs) consist of a polycrystalline diamond layer (PCD layer) bonded to a carbide substrate. The bond between the PCD layer and the carbide support is formed at high temperature, high pressure (HT/HP) conditions. Subsequent reduction of the pressure and temperature to ambient conditions results in stress development in both the PCD layer and carbide support due to differences in the thermal expansion and the compressibility properties of the bonded layers. The differential thermal expansion and differential compressibility have opposite effects of stress development as the temperature and pressure are reduced; the differential thermal expansion tending to cause compression in the PCD layer and tension in the carbide support on temperature reduction whereas the differential compressibility tends to cause tension in the PCD layer and compression in the carbide support.

Finite element analysis (FEA) of stress development and strain gage measurements confirm that the differential thermal expansion effect dominates resulting in generally compressive residual stresses (Note: there are localized zones of tension stresses present) in the PCD layer.

Upon heating a cutter, the diamond stress state will change from being in general compression to general tension. This "flip" in residual stresses occur below 700° C. range. The "flip" temperature increases with decreased bonding pressure (i.e. the pressure where the cutter temperature reaches the Co freezing point and bonding occurs).

Above the WC protrusions into the PCD layer there are high compressive stresses in the adjacent PCD layer at room temperature and pressure conditions. These stresses flip to tensions when the PDC cutter is heated in a brazing cycle and they can be mitigated in two ways:

(1) increase the "flip" temperature by decreasing the pressure at which the freezing occurs; or (2) reduce the Co content in the local region of the protrusion such that the protrusion's thermal expansion is closer to that of the PCD layer.

Figure 1B:
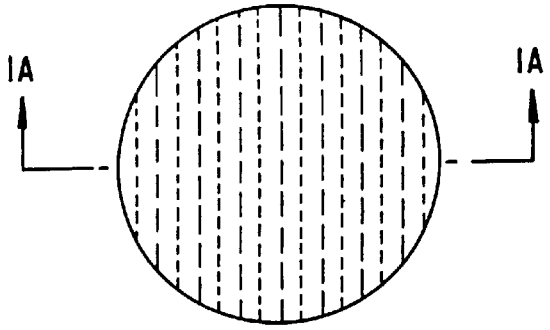
FIG. 1 is a cross-sectional view of a PDC cutter showing WC protrusions with lower Co content than the WC substrate.
Figure 1A:
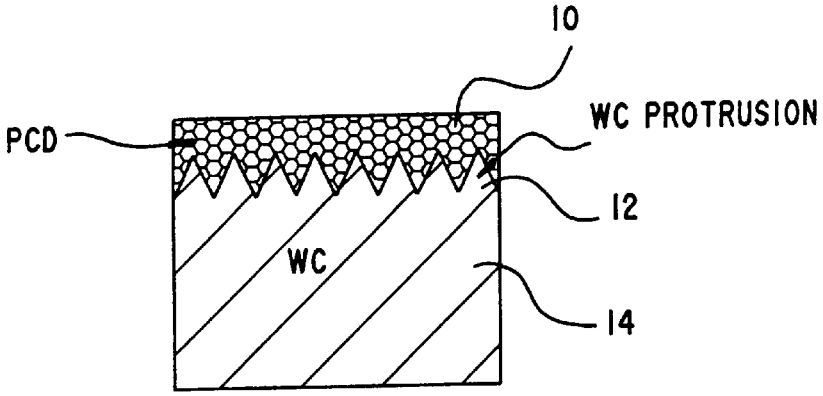
Figure 1C:
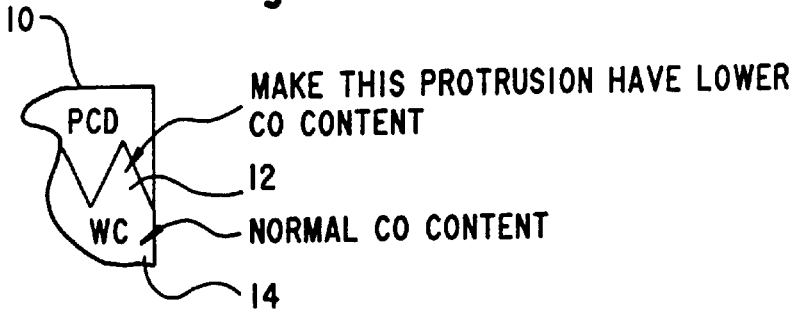

This second method is the subject of the present invention. Shown in FIG. 1 is a cross-sectional view of a PDC cutter comprising WC substrate 14 of normal Co content and WC protrusions 12 into the PCD layer 10 with low Co content. In this invention it is preferred that protrusions 12 have a Co content of 6% plus or minus 3%. This will be considered low Co content WC. The major WC substrate material 14 will have Co content of 13% plus or minus 3%. This will be considered normal Co content WC. The normal Co content WC substrate 14 is desirable for impact resistance and tension strength. The lower Co content WC is desirable only in the zone of protrusions 12.

Figure 2A:
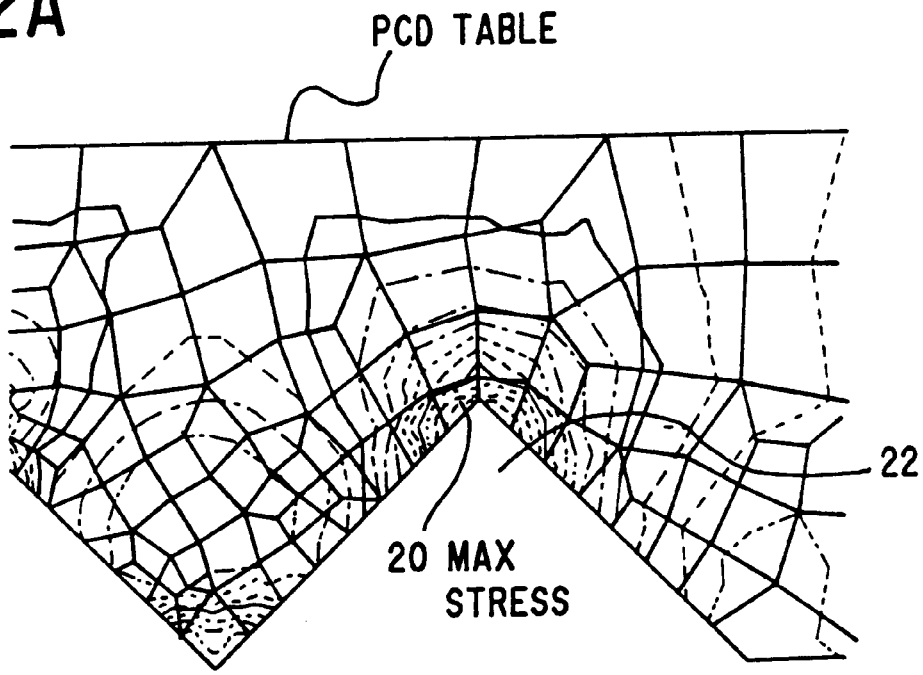
FIG. 2*a* shows finite element model results at 700 C. where the WC protrusions have normal Co content.
Figure 2B:
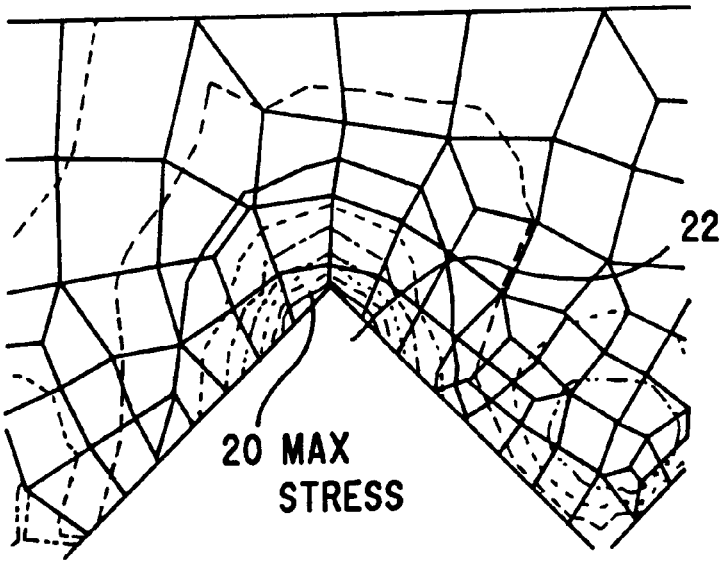
FIG. 2*b* shows finite element model results at 700 C. where the WC protrusions have low Co content.

FIG. 2*a* and 2*b* show finite element model results supporting that method (2) above does mitigate stresses at brazing temperatures. In FIG. 2*a*, WC protrusions 22 comprised normal Co content, and, in FIG. 2*b*, WC protrusions 22 comprised low Co content. As indicated in each figure, the finite element model results show that, at a brazing temperature of 700° C., maximum stress 20 was reduced by 26% through the reduction of the Co content in WC protrusions 22.

A number of methods for achieving the desired result of low Co content WC protrusions would be immediately apparent to those of skill in the art. Some of these are described below.

Figure 3A:
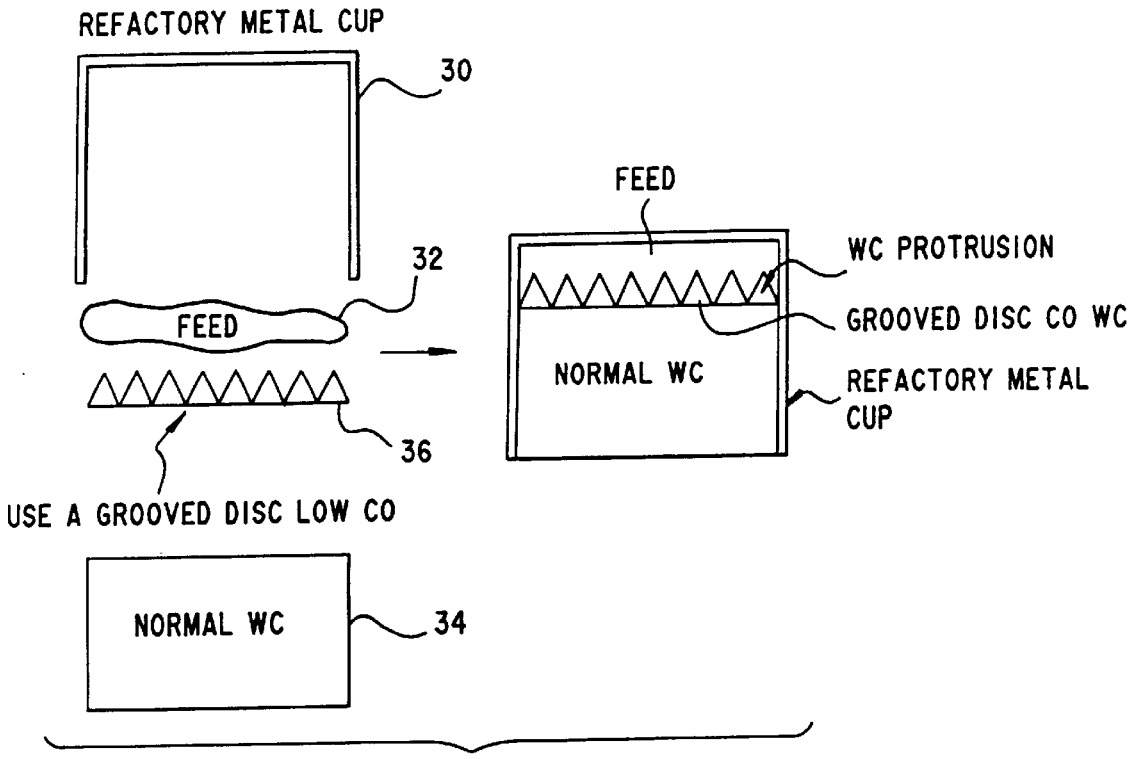
FIG. 3*a* shows a process for making a PDC cutter in accordance with the present invention using a grooved WC disc with a low Co content to form the WC protrusions.
Figure 3B:
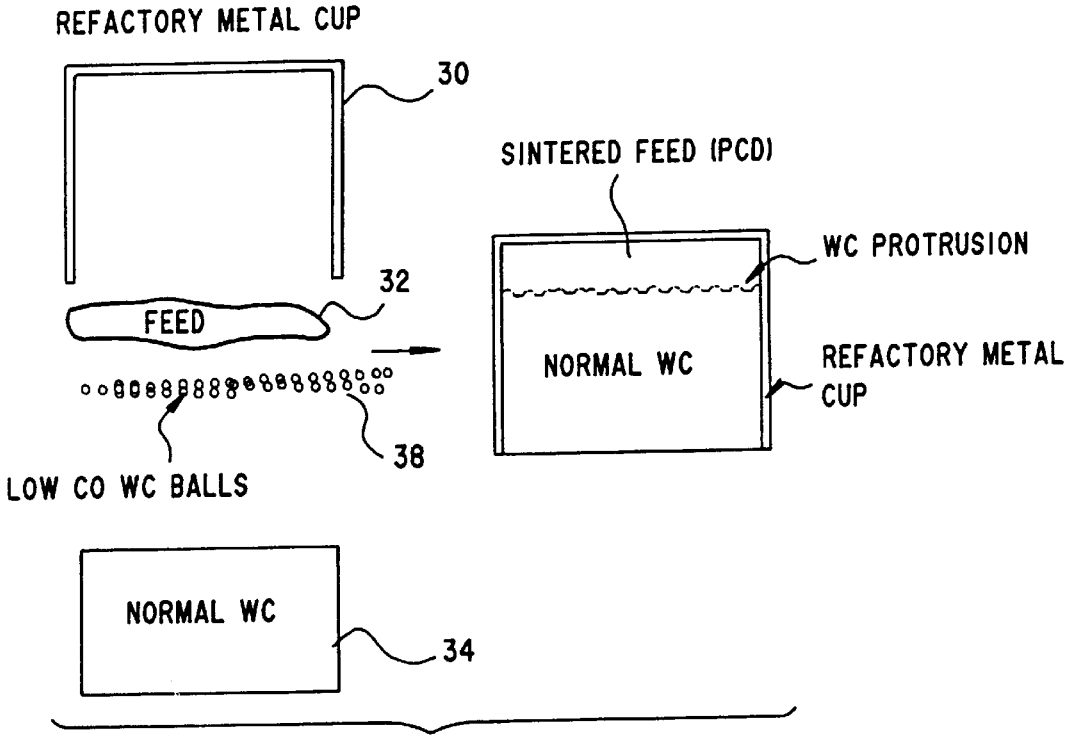
FIG. 3*b* shows a process for making a PDC cutter in accordance with the present invention using WC balls with low Co content to form the WC protrusions.
Figure 3C:
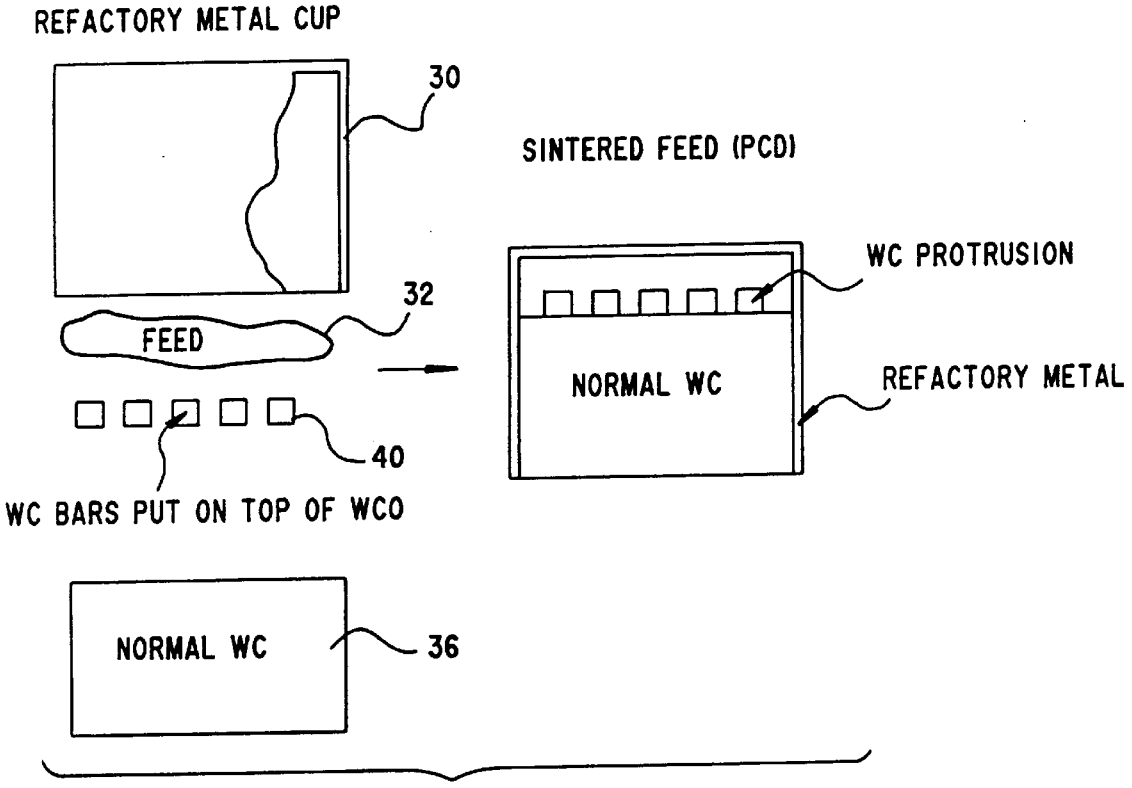
FIG. 3*c* shows a process for making a PDC cutter in accordance with the present invention using WC bars with low Co content to form the WC protrusions.

One method involves placing separate pieces of WC into the HT/HP process and assembling into the desired geometry. The WC protrusions into the PCD layer comprise low Co content WC while the rest of the substrate comprises normal Co content WC. FIGS. 3*a*, 3*b* and 3*c* show some embodiments of this concept.

Each figure shows the separate pieces to be combined for use in the HT/HP process and assembled into the desired geometry. A preferred embodiment of the present invention comprises PCD feed 32, WC substrate 34 with normal Co content, and any one of the following: 1) WC grooved disc 36 with low Co content, 2) WC balls 38 with low Co content or 3) WC bars 40 with low Co content, combined in refractory metal cup 30 as demonstrated in FIG. 3*a*, 3*b* and 3*c*, respectively. These figures represent only a few of the embodiments of the present invention.

Another method involves having a WC manufacturer supply a graduated Co content WC substrate in which the WC manufacturer provides integral WC substrates which have low Co content protrusions and the rest essentially normal Co content. It is important that it be noted that the decreased Co content is only desired in the protrusions.

Yet another method, and the most preferred method of the present invention, consists of controlling the removal of Co from the WC protrusions during sintering of the PDC cutter. During sintering of the PDC cutter, Co contained in the WC melts and sweeps into the PCD layer. Preferential removal of Co from the WC protrusion during sweep of Co from the WC substrate into the PCD layer would result in a WC protrusion with a lower thermal expansion, the object of the present invention. The amount of preferential Co removal can be controlled by altering the geometry of the WC protrusions and the volume fraction ratio of WC protrusions (into the PCD layer) to PCD protrusions (into the WC substrate).

Figure 4A:
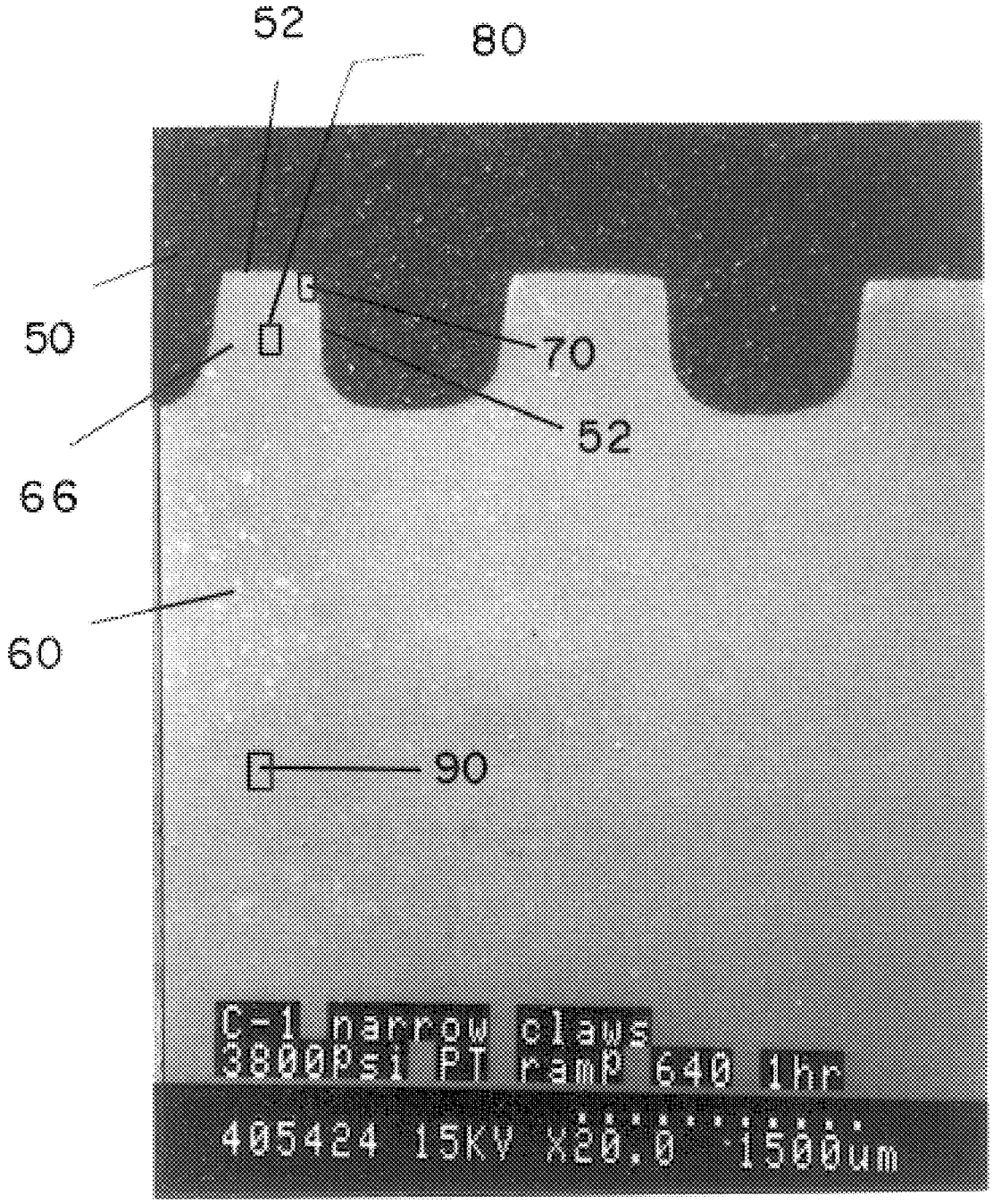
FIG. 4*a* is a low magnification Scanning Electron Microscope (SEM) photomicrograph that shows interpenetrating protrusions of WC and PCD, wherein the PCD is the dark material at the top of the photomicrograph.

FIGS. 4*a–d* are low (4*a*) and high (4*b,c* & *d*) magnification Scanning Electron Microscope (SEM) photomicrographs that demonstrate the removal of Co from the region of the WC substrate adjacent to the PCD layer, with the removal being dependant on the geometry of the protrusions. FIG. 4*a* is a low magnification SEM photomicrograph that shows penetrating protrusions 66 of WC 60 into PCD layer 50, with PCD layer 50 being the dark material at the top of the photomicrograph and WC substrate 60 being the light material at the bottom. FIG. 4*a* shows the WC-PCD interface 52 at a low magnification and serves as a reference to the specific source locations of FIGS. 4*b, c* and *d*. The positions of the magnified areas shown in FIG. 4*b, c* and *d* are indicated on FIG. 4*a* by three squares 70, 80 and 90, respectively, drawn on the SEM photograph in FIG. 4*a*.

Figure 4B:
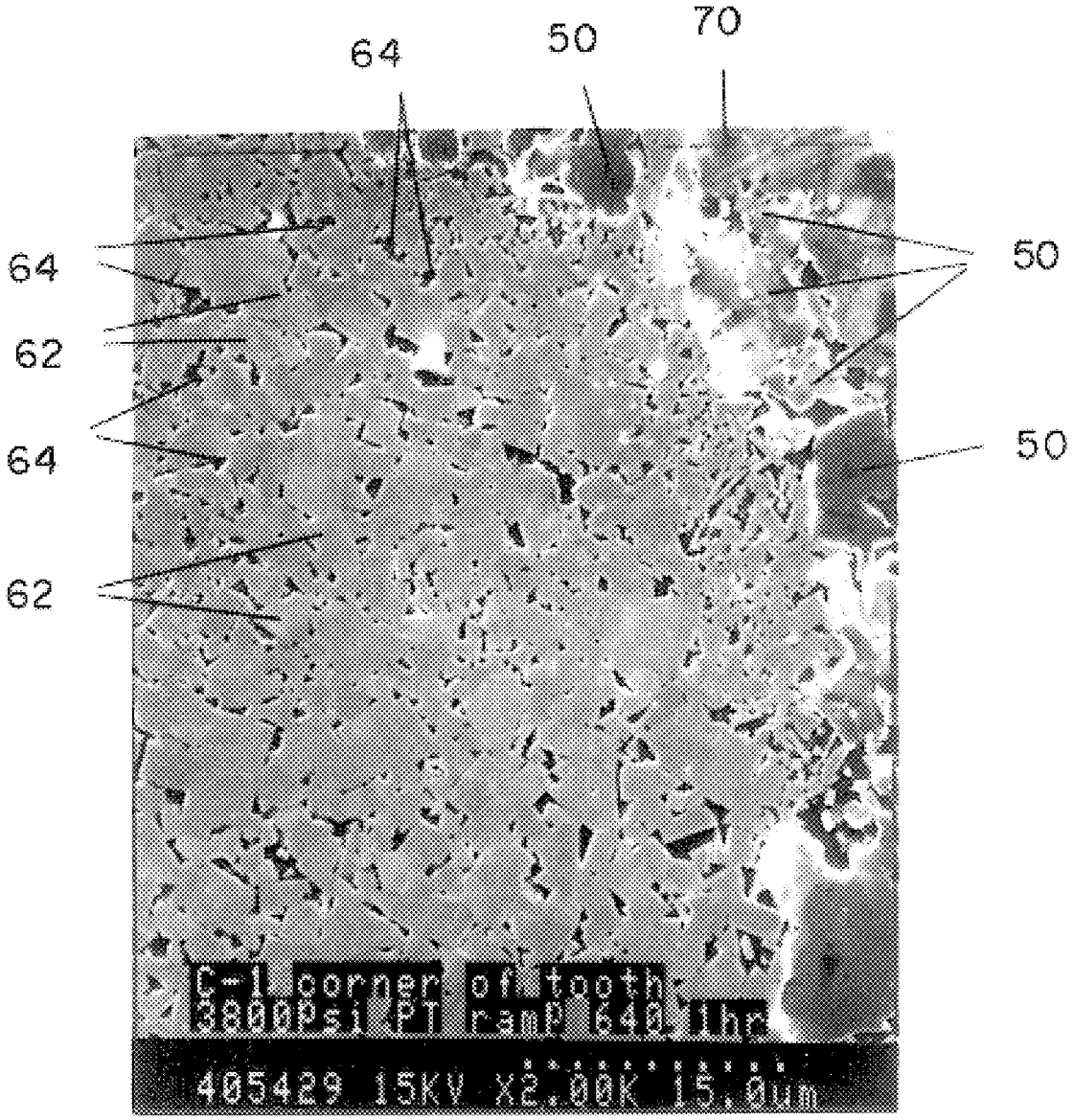
FIG. 4*b* is a high magnification SEM photo-micrograph of a portion of FIG. 4*a*, taken from the corner of one of the WC protrusions, which shows the WC with depleted Co content.
Figure 4C:
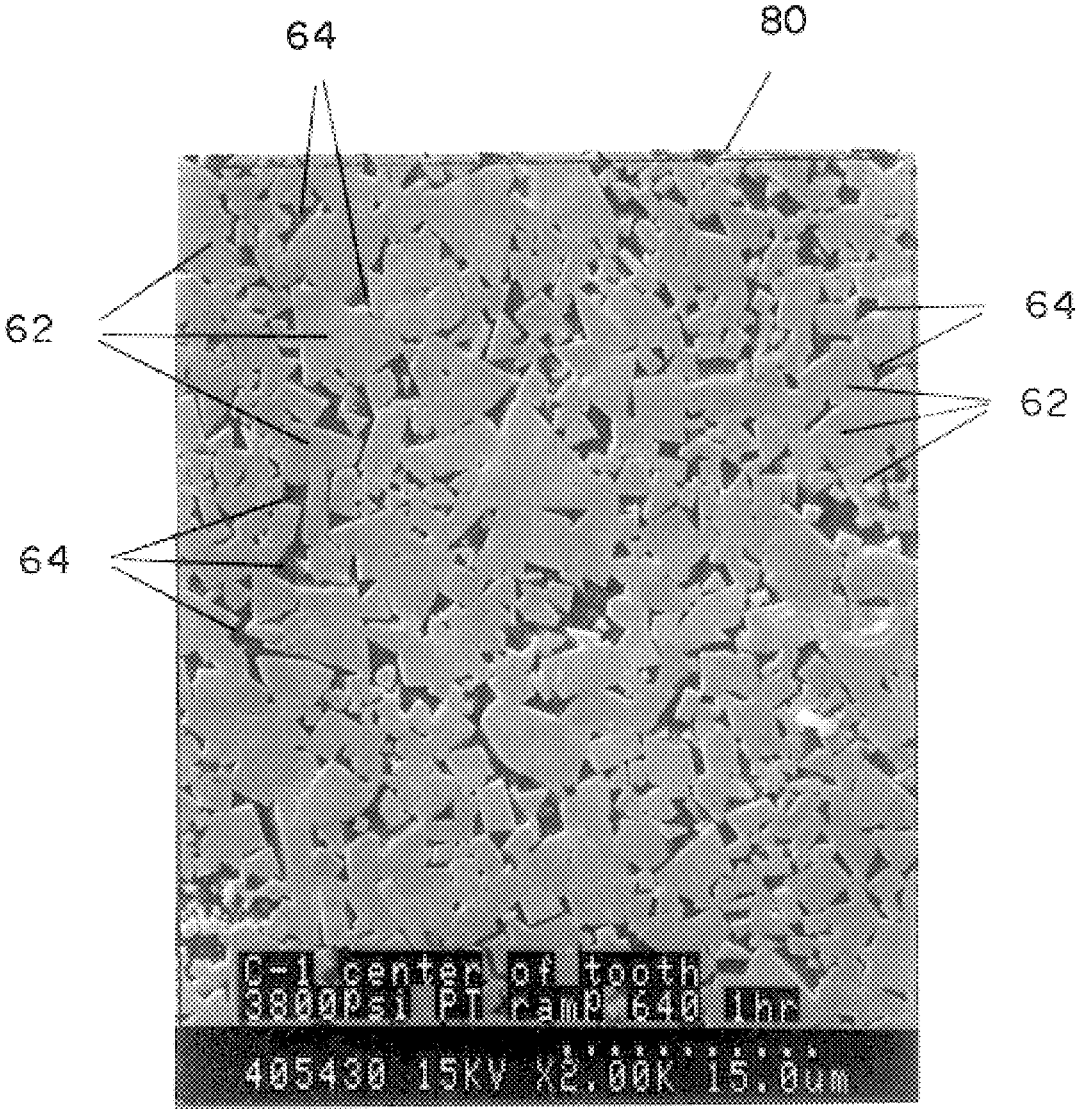
FIG. 4*c* is a high magnification SEM photo-micrograph of portion of FIG. 4*a*, taken in the center of the WC protrusion, which shows the WC with greater Co content than at the edge of the protrusion as shown in FIG. 4*b*.
Figure 4D:
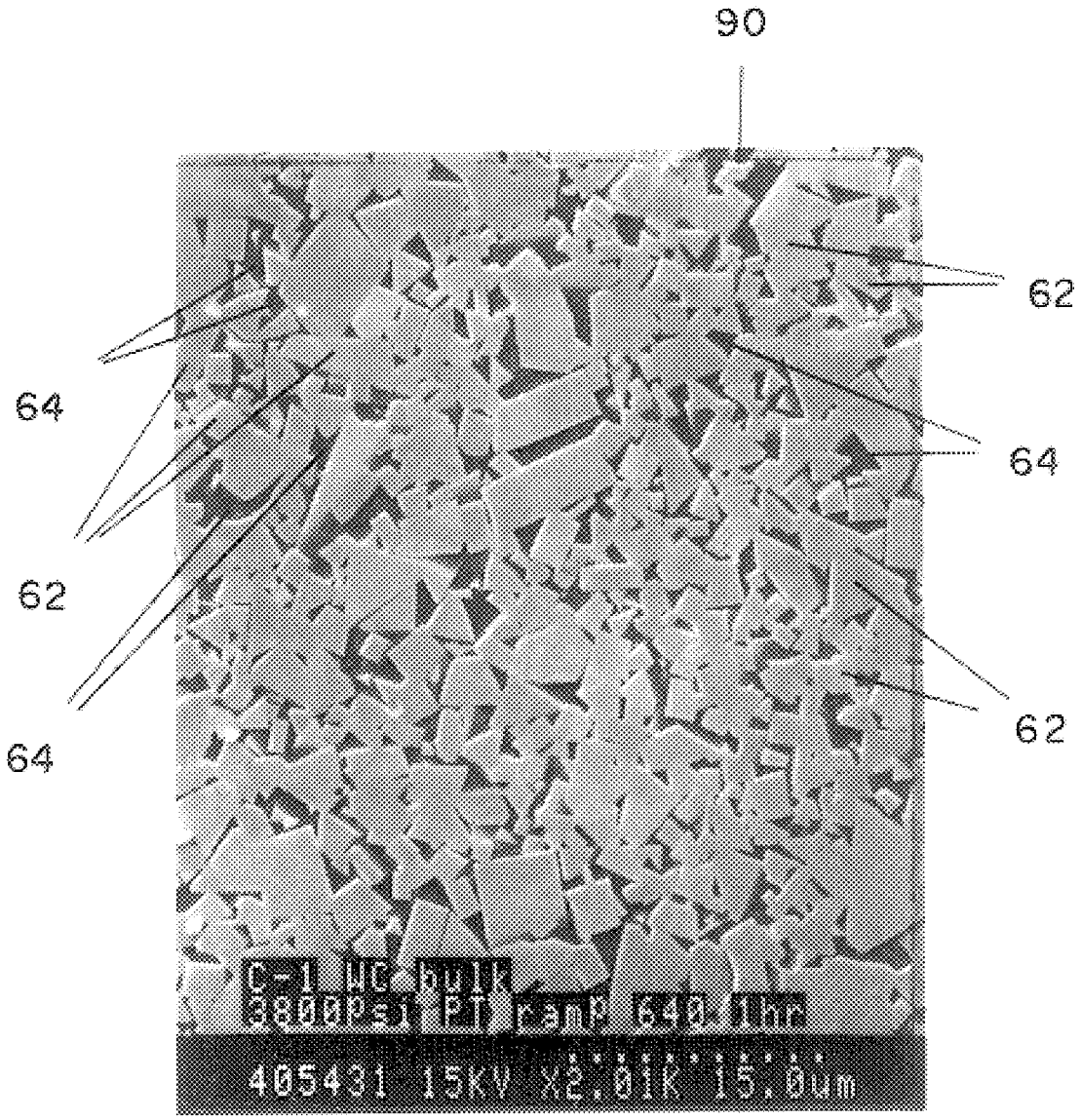
FIG. 4*d* is a high magnification SEM photo-micrograph of portion of FIG. 4*a*, taken in the center of the WC substrate, which shows the WC with greater Co content than in the protrusions as shown in FIG. 4*b* and 4*c*.

In FIGS. 4*b, c* and *d*, high magnification SEM photomicrographs of specific portions of FIG. 4*a* are shown. FIG. 4*b*, taken from the corner of one of the WC protrusions 66, shows depleted Co 64 in WC substrate 60 as compared to the Co content in FIG. 4*c* which was taken from the center of the protrusion 66. FIG. 4*c*, taken from the center of one of the protrusions 66, shows depleted Co 64 in WC substrate 60 as compared to the Co content in FIG. 4*d* which was taken in the center of WC substrate 60 a distance from WC-diamond interface 52.

The depleted Co 64 in the protrusion 66, as shown in FIG. 4*b* and *c*, will result in a desirably lower average thermal expansion for the WC protrusion 66. These SEM micrographs clearly show that if the surface area of WC protrusion 66 is high compared to the volume of WC protrusion 66, then a lower average content of Co 64 and a lower average thermal expansion coefficient for the protrusion 66 will result. As depicted by the SEM photomicrographs, FIGS. 4*b, c* and *d*, it is clear that the Co content of the WC substrate is depleted more in the areas closer to the WC-PCD interface 52.

Therefore, the specific geometry of the WC protrusions 66 effect the "sweep" of the Co 64 in the WC substrate into the PCD layer 50. The higher the area to volume ratio of the WC protrusion 66, the greater the Co depletion will be, and the lower the average thermal expansion coefficient for the protrusion 66. This will result in an improved match between the WC substrate 60 and the PCD layer 50, thereby enhancing the performance through improved residual stress at the WC-PCD interface 52.

The present invention is valuable as an improved way to manufacture PDC cutters with unique properties. The WC-PCD interface geometry of the present invention provides a better match between the WC substrate and the PCD layer. The primary advantage of this interface geometry being enhanced performance and less installation and/or brazing breakage due to improved residual stress at the WC-PCD interface.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

What is claimed is:

1. An improved abrasive tool insert comprising:

an abrasive layer; and a cemented carbide substrate having a metal binder therein and is bonded to said abrasive layer;

wherein one or more cemented carbide protrusions extend from said substrate into said abrasive layer, and wherein the metal binder content in each of said protrusions is less than the metal binder content of said substrate.

2. A tool insert according to claim 1 wherein said abrasive layer is composed of polycrystalline diamond.

3. A tool insert according to claim 1 wherein said cemented carbide is tungsten carbide.

4. A tool insert according to claim 1 wherein said metal binder is selected from the group consisting of cobalt, iron, nickel, platinum, titanium, chromium, tantalum and alloys thereof.

5. A tool insert according to claim 1 wherein the metal binder content in said protrusions ranges from about 3–9% by weight on average and the metal binder content of said substrate ranges from about 10–16% by weight on average.

6. A tool insert according to claim 1 wherein said protrusions are pyramid, cone or truncated-cone shaped.

7. A tool insert according to claim 1 wherein said protrusions are block shaped.

8. A tool insert according to claim 1 wherein said protrusions are sinusoid, ellipsoid or sphere shaped.

9. An improved abrasive tool insert comprising:

a polycrystalline diamond layer; and a tungsten carbide substrate bonded to said diamond layer;

said tungsten carbide substrate has a metal binder content of from about 10–16% by weight on average; and wherein one or more tungsten carbide protrusions extend from said tungsten carbide substrate into said diamond layer, said tungsten carbide protrusions having a binder metal content ranging from about 3–9% by weight on average.

10. An improved abrasive tool insert according to claim 9 wherein said protrusions are pyramid, cone or truncated-cone shaped.

11. An improved abrasive tool insert according to claim 9 wherein said protrusions are block shaped.

12. An improved abrasive tool insert according to claim 9 wherein said protrusions are sinusoid, ellipsoid or sphere shaped.

* * * * *